United States Patent [19]

Means, Jr.

[11] Patent Number: 5,050,632

[45] Date of Patent: Sep. 24, 1991

[54] ANGLE STOP BOX

[76] Inventor: Orville D. Means, Jr., 25570 Highway 79, San Ysabel, Calif. 92070

[21] Appl. No.: 625,849

[22] Filed: Dec. 11, 1990

[51] Int. Cl.[5] ..... F16L 5/00

[52] U.S. Cl. ..... 137/360; 137/315; 4/192

[58] Field of Search ..... 137/360, 315; 4/191; 312/229, 242

[56] References Cited

U.S. PATENT DOCUMENTS

| | | | |
|---|---|---|---|
| 3,831,624 | 8/1974 | Doumany | 137/360 |
| 4,158,471 | 6/1979 | Logsdon | 137/360 |
| 4,410,004 | 10/1983 | Kifer et al. | 137/360 |
| 4,564,249 | 1/1986 | Logsdon | 137/360 |

*Primary Examiner*—A. Michael Chambers

*Attorney, Agent, or Firm*—Baker, Maxham, Jester & Meador

[57] ABSTRACT

An angle stop box for the installation of cut off lines to plumbing fixtures, comprises a generally box-like housing having an open front and an outwardly extending flange for attachment to a wall stud, an aperture through one wall of the housing, a stub line extending through the aperture and secured in the wall, an angle stop valve mounted on one end of the stub line within the housing, and an extension wall extending beyond the flange for extending through a wall panel and a peripheral cover for extending over and covering the juncture of the housing and a wall cover.

13 Claims, 1 Drawing Sheet

ANGLE STOP BOX

BACKGROUND OF THE INVENTION

The present invention relates to plumbing fixtures and pertains particularly to an improved method and apparatus for angle stopping.

Water supply connections are provided to certain plumbing fixtures, such as basins and commodes, by what is referred to as an angle stop. The water supply lines typically run between studs behind the wall in a typical frame building structure, and either a T or a ninety degree elbow are used to provide a connection to a nipple or stub line that extends outward through the wall. A small cut-off valve is installed on each of the supply lines, and a flex line extends and connects from the cut-off valve to the plumbing fixture.

These angle stop installations are roughed in during construction by running the hot and cold water supply lines through or between the studs to the appropriate connection location. A strap is attached between the stubs, and stub out lines are mounted in the strap and connected to the water lines and extend outward beyond the expected wall surfaces and capped. The plumber then waits until the finish work is done, including wall board plastering and painting and the like, before he returns to complete the connections to the plumbing fixture. The plumber must be sure to have buckets available to catch the water which may be in the pipes when they are opened. He must scrape paint and plaster from the outer surface of the lines, and cut them to the proper length to install the angle stop valve. He must then fit and tighten the fitting sleeve of the angle stop onto the copper pipe. He must make sure that he does not over or under tighten the nut, such as to cause leaks. He then installs the flex lines to the fixture.

The applicant has devised an angle stop unit which may be initially installed in place, and fully ready for attachment to the plumbing fixture when the finish work is completed.

SUMMARY AND OBJECTS OF THE INVENTION

It is the primary object of the present invention to provide an improved method and apparatus for the installation of angle stops.

In accordance with a primary aspect of the present invention, an angle stop unit comprises a box which includes an integral bracket, cut-off valve and line fitting.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
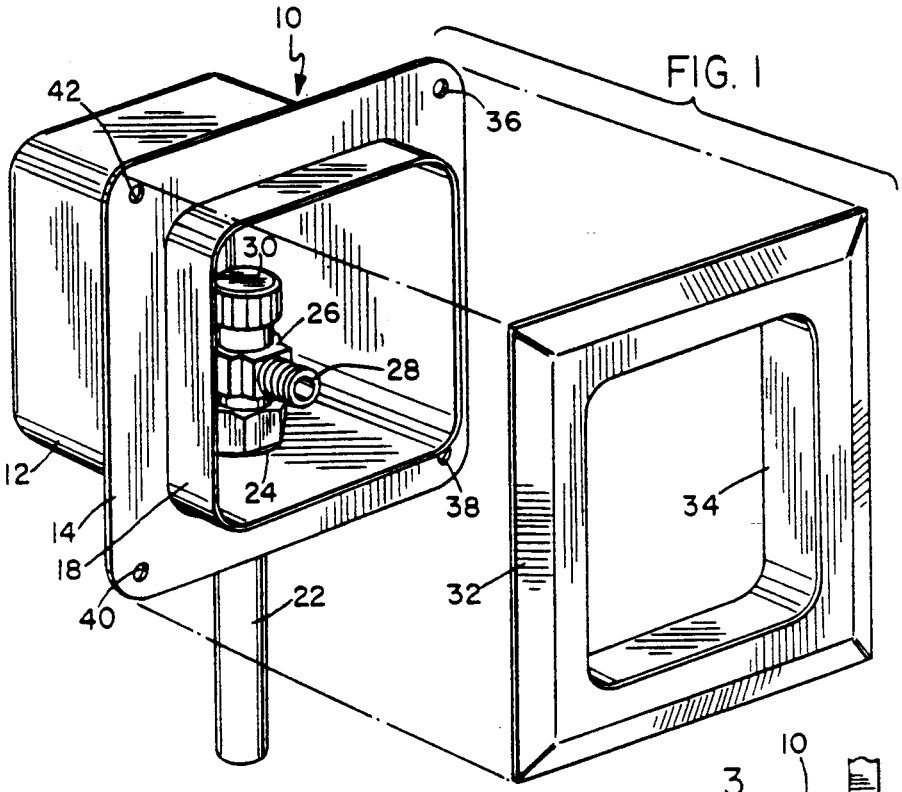
FIG. 1 is a perspective view of the angle stop box with the cover plate separated.

Referring to FIG. 1, an exemplary embodiment of an angle stop box according to the present invention, designated generally by the numeral 10, is illustrated. The overall assembly comprises a generally rectangular box-like housing having an open front, with a peripheral mounting flange spaced from a peripheral edge of the front. In this illustration, the angle box comprises a first or outer box like housing 12, which is preferably constructed out of thin sheet metal having radially outward extending peripheral mounting or attachment flange 14 for attachment to building studs or the like. An inner housing 16 of a box-like form of a size just to fit snugly within the outer housing includes a forwardly extending lip or extension 18 of approximately ⅝" to extend beyond flange 18 to extend through drywall. Different lengths may be provided for different thicknesses of drywall. It will also be appreciated that the housing may also be constructed with a single thickness of wall and attachment flanges be attached thereto. It may also be constructed of plastic and molded as a unitary construction.

The inner housing 16 is fitted within the outer housing and a common or aligned through bore 20, in what would be either a top or bottom wall depending on orientation, receives a stub line or short section of copper pipe 22, frequently referred to as a nipple, which extends therethrough and is secured in place by a copper grommet 24. The copper grommet 24 is selected to fit the pipe snugly, so that when crimped into the hole, it also tightly grips the outer surface of the pipe 22 and secures it in place. Water lines or pipes of copper which contact other metal in the building structures must be shielded therefrom by a copper strap or other structure. In this arrangement, the grommet serves the function of isolating or grounding the copper line to the metal box and also securing it rigidly to the housing. It also functions to transfer the heat generated by soldering of the pipe into the housing and protects the valve.

The inner end of the copper pipe 22 receives a cut-off valve unit 26 having the usual threaded connection 28 for connecting to the plumbing fixture line and a cut-off handle 30. These valves are available as an off-the-shelf item from plumbing and hardware stores. The line or pipe 22 may be provided with any suitable means for connection to a water supply line.

A finishing cover or flange 32 has a peripheral configuration as radially outward extending flange members, and an inward extending lip structure 34 for extending into the outward extending lip 18 of the inner housing. This forms a finishing cover or structure around the opening in the drywall to which the lip 18 protrudes. The attachment flange 14 is provided with a plurality of mounting holes 36, 38, 40 and 42 for receiving nails or screws for mounting purposes.

Figure 2:
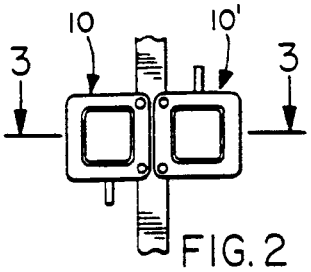
FIG. 2 illustrates two boxes attached to a stud.
Figure 3:
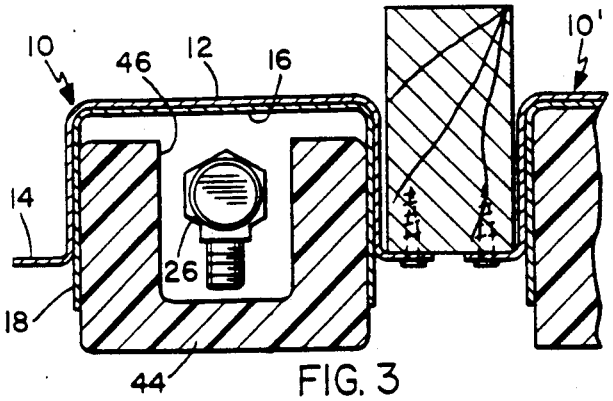
FIG. 3 is an enlarged sectional view taken on line 3—3 of FIG. 2, with the protective inserts in place for wall finishing.

Referring to FIG. 2, a pair of identical stop boxes 10 and 10' are each attached to opposite sides of a common stud by means of a pair of screws through holes in a respective flange thereon. The boxes are shown with opposite vertical installation to illustrate the accommodation of a supply from below or from above. The boxes each have a valve and nipple integral therewith and are connected directly to the supply lines, with the valve shut off to complete the basic installation. Thereafter, specially constructed blocks of foam 44, as shown in FIG. 3, are inserted into the boxes to protect the valve unit and prevent filling thereof with plaster and the like during wall board installation and finishing. This enables finish work to be completed on the interior walls of the building without damage to the valve. Thereafter, the plumber returns, removes the foam block 44 and installs a finish cover 32. The then installs the connecting flex lines to the valve and to the plumbing fixture, and the installation is complete.

Figure 4:
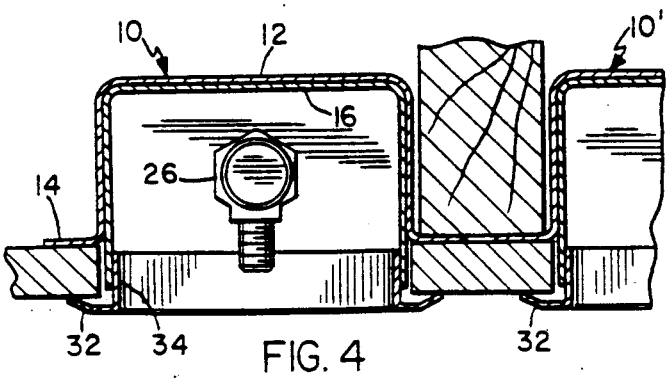
FIG. 4 is a similar sectional view with the cover plates in place.
Figure 5:
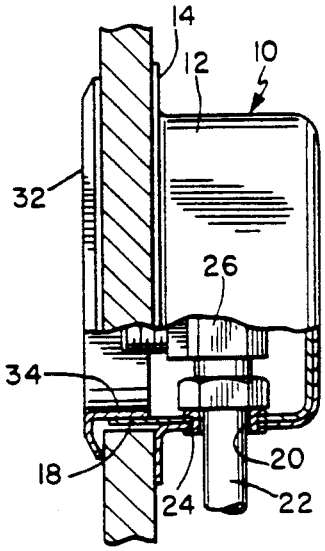
FIG. 5 is a side elevation view partially cut away of a finished box installation as shown in FIG. 4.

In operation, when a plumber is installing the angle stop when the building structure has been framed, he simply locates the position for the stop box or boxes, and connects the copper line 42 to the water supply line by soldering or other means. He then simply attaches or mounts the box by means of nails or screws through flange 14 to the adjacent wall stud, as shown in FIGS. 2-4. He then cuts off the valve to prevent leakage of water when the lines are filled, and inserts a foam block 44 having a cut out 46 for the valve space into the angle stop box. This prevents the filling of the box with plaster, putty, paint and other debris when the building is being finished. Once the drywall has been installed and finished, as shown in FIGS. 3 and 4, the plumber simply returns, removes the foam block 44, inserts the flange member 32 in place, and installs the flex line to the plumbing fixture. This completes the installation and eliminates the many steps of the prior art approach, and also the clean-up and line connection work after installation of the plumbing fixture.

While I have illustrated and described my invention by means of a specific embodiment, it is to be understood that numerous changes and modifications may be made herein without departing from the spirit and scope of the invention as defined in the intended claims. Applicant sincerely believes that the aforementioned specification and drawings fully enables one of ordinary skill in the art to make and practice the invention as contemplated herein. Moreover, applicant sincerely believes that the illustrated and described embodiment represents the best mode for carrying out the invention as contemplated at this time.

I claim:

1. An angle stop box for the installation of cut off lines to plumbing fixtures, comprising:

a generally box-like housing having an open front and an outwardly extending flange for attachment to a wall stud;

an aperture through one wall of said housing;

a stub line extending through said aperture and secured in said wall by means of a grommet;

an angle stop valve mounted on one end of said stub line within said housing; and an extension wall extending beyond said flange for extending through a wall panel, wherein said housing comprises an outer housing defining said outwardly extending flange, and an inner housing defining said extension wall.

2. An angle stop box according to claim 1 further comprising:

a detachable outer cover having wall means for extending through a wall panel and frictionally engaging the internal wall surfaces of said housing, said cover extending outward for covering around an opening in a wall panel surrounding an installed housing.

3. An angle stop box according to claim 1 wherein outer housing and said inner housing are formed of sheet metal.

4. An angle stop box according to claim 3 wherein said stub line and said grommet are made of copper and said copper grommet extends through said aperture and rigidly clamps said stub line therein.

5. An angle stop box according to claim 1 wherein said stub line and said grommet are made of copper and said copper grommet extends through said aperture and rigidly clamps said stub line therein.

6. An angle stop box for the installation of cut off lines to plumbing fixtures, comprising:

a generally box-like housing having an open front and an outwardly extending flange for attachment to a wall stud;

an aperture through one wall of said housing;

a stub line extending through said aperture and secured in said wall;

an angle stop valve mounted on one end of said stub line within said housing;

an extension wall extending beyond said flange for extending through a wall panel; and a foam block sized and shaped to fit around said stop valve and protectively fill said housing during construction finishing work.

7. An angle stop box kit for the installation of cut off lines to plumbing fixtures, comprising;

an outer generally box-like housing having an open front and an outwardly extending flange for attachment to a wall stud;

an inner housing defining an extension wall extending beyond said flange for extending through a wall panel;

a pair of aligned apertures through one wall of said housings;

a stub line extending through said apertures and secured in said wall by means of a grommet; and an angle stop valve mounted on one end of said stub line within said housing.

8. An angle stop box according to claim 7 further comprising a detachable outer cover having wall means for extending through a wall panel and frictionally engaging the internal wall surfaces of said housing, said cover extending outward for covering around an opening in a wall surrounding an installed housing.

9. An angle stop box according to claim 8 wherein outer housing and said inner housing are formed of sheet metal.

10. An angle stop box according to claim 9 wherein: said stub line and said grommet are made of copper and said copper grommet extends through said aperture and rigidly clamps said stub line therein.

11. An angle stop box according to claim 10 further comprising a foam block sized and shaped to fit around said stop valve and protectively fill said housing during construction finishing work.

12. An angle stop box kit for the installation of cut off lines to plumbing fixtures, comprising;

an outer generally box-like sheet metal housing having an open front and an outwardly extending flange for attachment to a wall stud;

an inner generally box-like sheet metal housing defining an extension wall extending beyond said flange for extending through a wall panel;

a pair of aligned apertures through one wall of said housings;

a copper stub line extending through said apertures;

a copper grommet extending through said apertures around said stub line and securing said stub line in said wall;

an angle stop valve mounted on one end of said stub line within said housing;

a detachable outer cover having wall means for extending through a wall panel and frictionally engaging the internal wall surfaces of said housing, said cover extending outward for covering around an opening in a wall surrounding an installed housing.

13. An angle stop box according to claim 12 further comprising a foam block sized and shaped to fit around said stop valve and protectively fill said housing during construction finishing work.

* * * * *